US006478413B1

(12) United States Patent
Motegi et al.

(10) Patent No.: US 6,478,413 B1
(45) Date of Patent: Nov. 12, 2002

(54) CHARGING PLATE FOR LIQUID JET CHARGING DEVICES AND METHOD FOR MAKING SAME

(75) Inventors: Akira Motegi, Yokosuka (JP); Ryoji Kaneko, Kawasaki (JP)

(73) Assignee: Tokyo Kikai Seisakusho, Ltd. (JP)

( * ) Notice: Subject to any disclaimer, the term of this patent is extended or adjusted under 35 U.S.C. 154(b) by 0 days.

(21) Appl. No.: 09/431,885

(22) Filed: Nov. 2, 1999

(30) Foreign Application Priority Data

Nov. 4, 1998 (JP) ..... 10-312805

(51) Int. Cl.[7] ..... B41J 2/085
(52) U.S. Cl. ..... 347/76
(58) Field of Search ..... 347/76, 74, 73, 347/77

(56) References Cited

U.S. PATENT DOCUMENTS 4,223,321 A * 9/1980 Kenworthy ..... 347/76
4,427,986 A * 1/1984 Iyoda et al. ..... 347/76
4,636,808 A * 1/1987 Herron ..... 347/76
5,475,411 A * 12/1995 Strain et al. ..... 347/90

FOREIGN PATENT DOCUMENTS

EP 0 744 290 A2 * 11/1996 ..... B41J/2/085
JP 9-314847 12/1997

* cited by examiner

*Primary Examiner*—Anh T. N. Vo
(74) *Attorney, Agent, or Firm*—McGlew and Tuttle, P.C.

(57) ABSTRACT

An object of the present invention to make it possible to bring precision-machined electrodes close to liquid filaments being injected through orifices, and manufacture a charging plate easily and at low cost. An unrounded edge on which a work surface on an upper surface intersects with one side surface is formed on a substrate made of non-conductive substance, and a plurality of electrodes are disposed, with the distal ends thereof aligned with the edges.

18 Claims, 3 Drawing Sheets

CHARGING PLATE FOR LIQUID JET CHARGING DEVICES AND METHOD FOR MAKING SAME

FIELD OF THE INVENTION

The present invention relates to a charging plate for liquid jet charging devices wherein a liquid filament injected through an orifice provided on an orifice member is electrostatically charged so that charged liquid droplets are formed by mechanically subdividing the liquid filament, and a method for making the same.

BACKGROUND OF THE INVENTION

This type of charging plate having a construction where a plurality of electrodes are arranged in parallel and printed on a side surface of a substrate of the charging plate is well known. Current-carrying parts for electrically connecting each of the electrodes are printed on the upper surface of the substrate.

FIG. 8 is a cross-sectional side view of assistance in explaining the construction of a liquid jet charging device having a charging plate of the conventional type (hereinafter referred to the prior art.). In the figure, 1C denotes a charging plate for the device. The charging plate 1C has such a construction that a plurality of electrodes 4 made of electrically conductive substance are arranged on one side surface 3 of a substrate 2 made of non-conductive substance, such as ceramics, at almost equal intervals in the depth direction (into the page in the figure) of the side surface 3, and current-carrying parts 5 made of conductive substance are provided on an upper surface 7 of the substrate 2 as extending from the electrodes 4 individually.

Next, numeral 21 denotes an orifice member on the lower part of which an orifice 22 is provided.

The liquid jet charging device having the charging plate 1C of the conventional type is operated in the following manner.

The pressurized liquid is continuously injected as a liquid filament 23 through an orifice on a high-frequency oscillated orifice member 21. Liquid droplets 24 and 24' are generated and flown one after another as the liquid filament 23 is forcibly subdivided from the tip of the liquid filament 23 in accordance with the frequency of the high-frequency oscillation.

When a liquid inside the orifice member 21 is appropriately pressurized and vibrated at an appropriate frequency to obtain the droplets 24 and 24' in a stable state, the liquid filament 23, whose length a is not more than 1 millimeter, is divided into droplets 24 and 24' beyond the tip thereof and flies in the air.

To cause the droplets 24 and 24' to be produced in an adequately charged state as the liquid filament 23 is subdivided, it is known that the electrode 4 be disposed as near as a few micrometers to ten-odd micrometers by the side of the liquid filament 23, and in front and rear of a location where the liquid filament 23 is subdivided into the droplets 24 and 24' beyond the tip thereof.

Furthermore, it is also known that as a DC voltage is applied to the electrode 4 for a very short time in synchronism with the timing at which the liquid filament 23 is subdivided into droplets 24 and 24' from the tip thereof, an electric charge is induced for that very short time in the liquid filament corresponding to the electrode 4, and as a result, the droplets 24 and 24' divided from the liquid filament 23 travel in the air in a charged state.

The conventional type of charging plate 1C shown in FIG. 8, on the other hand, is given in advance appropriate roundness on the upper and lower edges 101 and 102 of one side surface 3 of the substrate 2 made of non-conductive material, as shown in the figure. An electrically conductive film is formed over an area ranging from the side surface 3 to the upper surface 7 of the substrate 2, and then a plurality of electrodes 4 are formed on the side surface 3 of the substrate 2 and the current-carrying portions 5 extending from the electrodes 4 are formed on the upper surface 7 of the substrate by removing the conductive film from parts other than the desired electrodes 4 and current-carrying portions 5.

The charging plate 1C is given in advance appropriate roundness on the upper and lower edges 101 and 102 consisting of the upper surface 7, the lower surface 6 and the side surface 3 of the substrate 2 for a machining convenience, with the radii of the roundness at the upper and lower edges being 0.5 millimeters to 1 millimeter.

Forming roundness on one edge of both the edges 101 and 102 has been particularly effective in preventing an end 111 of the current-carrying part 6, which is formed as extending continuously from the electrode 4 formed on the side surface 3 to the upper surface 7 via the edge 101, from being tapered off or broken off.

As an example of the prior art pertaining to the manufacturing method, a method for manufacturing a charging plate disclosed in Japanese Published Unexamined Patent Application No. Hei-9(1997)-314847 (hereinafter referred to as the prior art) is known. The prior art discloses a method for manufacturing a charging plate comprising the following five steps to form electrodes and current-carrying parts on a substrate.

That is, a charging plate is manufactured through a substrate preparation step, a step for forming electrodes made of electrically conductive material on a side surface of the substrate, a step for forming first current-carrying parts connecting ends of the electrodes on an upper surface of the substrate, a step for forming second current-carrying parts made of electrically conductive material on the upper surface of the substrate by bonding the second current-carrying parts to the first current-carrying parts, and a step for coating the upper surface of the substrate with a dielectric material.

In these steps, the electrodes and the first and second current-carrying parts are formed by screen- or stencil-printing and curing an electrically conductive paste. A method for forming the electrodes and the current-carrying parts by exposing the substrate using an electrically conductive photoresist is also disclosed.

The aforementioned charging plates for liquid jet charging device and the methods for making the same have the following problems to be solved.

In the prior art, a charging plate 1C is manufactured by forming a film of electrically conductive material over an area ranging from the side surface 3 to the upper surface 7 of a substrate made of non-conductive material, and then forming a plurality of electrodes 4 and current-carrying parts 5 by etching and other means. This tends to cause the shape of the electrodes 4 formed on the side surface 3 to be collapsed at the distal ends thereof, resulting in irregular distal ends of the electrodes.

As a result, even when each electrode 4 is disposed facing the liquid filament 23 injected through the orifice, the distance between each electrode and the liquid filament 23, which is critical to charge the liquid filament 23, tends to be irregular. Furthermore, because the radius of roundness on the edge 101 of the side surface 3 of the charging plate 1C is closely approximate to the length a of the liquid filament 23, which is approximately 1 millimeter, each electrode 4 cannot be brought adequately close to the liquid filament 23, making the liquid filament 23 injected through the orifice 22 unstable. This leads to some droplets 24 and 24' produced from the tip of the liquid filament 23 failing to be charged.

In other words, even if attempts are made to bring the charging plate 1C close to the liquid filament 23 injected through the orifice 22, and close to the lower surface of the orifice member 21 so as to bring the electrode 4 provided on the side surface 3 of the charging plate 1C, the edge 101 consisting of the side surface 3 and the upper surface 7 of the charging plate 1C having a roundness with a radius of almost the same size as the length a of the liquid filament 23 prevents the edge 111 of each electrode 4 from being placed adequately close to the liquid filament 23 even if the upper surface 7 of the charging plate 1C is brought as close as almost touching the lower surface of the orifice member 21. Thus, the liquid filament 23 cannot be effectively and invariably charged, and part of the droplets 24 and 24' produced from the liquid filament 23 fail to be charged.

Next, the charging plate manufactured according to the prior art involves as many as five complicated process steps. This leads to increased manufacturing man-hours and cost.

Furthermore, the manufacturing process according to the prior art is divided into steps for forming electrodes made of conductive material on the side surface of a substrate, forming a first current-carrying part made of conductive material on the upper surface of the substrate, and then forming a second current-carrying part. This tends to cause incomplete electrical connection between the electrodes and the first and second current-carrying parts connected thereto, resulting in imperfect electrical continuity.

Forming current-carrying parts at minute pitches corresponding to a plurality of electrodes formed at minute pitches requires a separate complicate process.

SUMMARY OF THE INVENTION

It is a first object of the present invention to solve these problems.

It is a second object of the present invention to form a plurality of electrodes and current-carrying parts with high precision.

It is a further object of the present invention to make it possible bring electrodes formed with high precision close to liquid filaments injected from orifices, thereby charging the liquid filaments instantaneously in an effective and stable state as necessary, so that, droplets produced from the liquid filaments can be reliably charged.

It is a still further object of the present invention to provide a method for manufacturing a charging plate on which current-carrying parts are formed with ease and at low cost.

To accomplish these objectives, the present invention provides a charging plate for liquid jet charging devices in which liquid filaments injected through orifices provided on an orifice member is charged, so that charged droplets are produced by subdividing the liquid filaments, characterized in that an unrounded edge at which a work surface on an upper surface intersects with one side surface is formed on a substrate made of non-conductive material, a plurality of electrodes made of conductive material are formed on the one side surface of the substrate, with the distal end thereof aligned with the unrounded edge, at almost equal intervals in the longitudinal direction (in the depth direction in FIG. 8) of the edge, current-carrying parts made of conductive material individually extending from the electrodes are formed on the lower surface of the substrate, and the work surface on the upper surface and the side surface of the substrate, both constituting the edge, form an almost right angle or a slightly smaller angle than a right angle.

The present invention also provides a method for manufacturing a charging plate comprising a first step for forming a film of a conductive material over an area ranging from one side surface to lower surface of a substrate made of non-conductive material, a second step for forming a plurality of electrodes on one side surface of the substrate and forming current-carrying parts extending from the electrodes on the lower surface of the substrate by partially removing the conductive film, and a third step for forming a work surface obtained by removing part of the upper surface so that the side surface of the substrate has a predetermined thickness, and causing an edge at which the work surface on the upper surface intersects with the side surface to align with the distal ends of the electrodes.

Furthermore, the second step comprises a corrosion-preventive film forming step for covering with at corrosion-resistant film a portion on which the conductive electrodes and current-carrying parts extending from the electrodes have been formed and an etching step for removing the portion coated with conductive film, excluding the portion coated with corrosion-preventive film, from the substrate.

BRIEF DESCRIPTION OF THE DRAWINGS

In the figures, like parts or parts having essentially the same effects are indicated by like numerals used in describing the prior art.

DETAILED DESCRIPTION OF PREFERRED EMBODIMENTS

Figure 1:
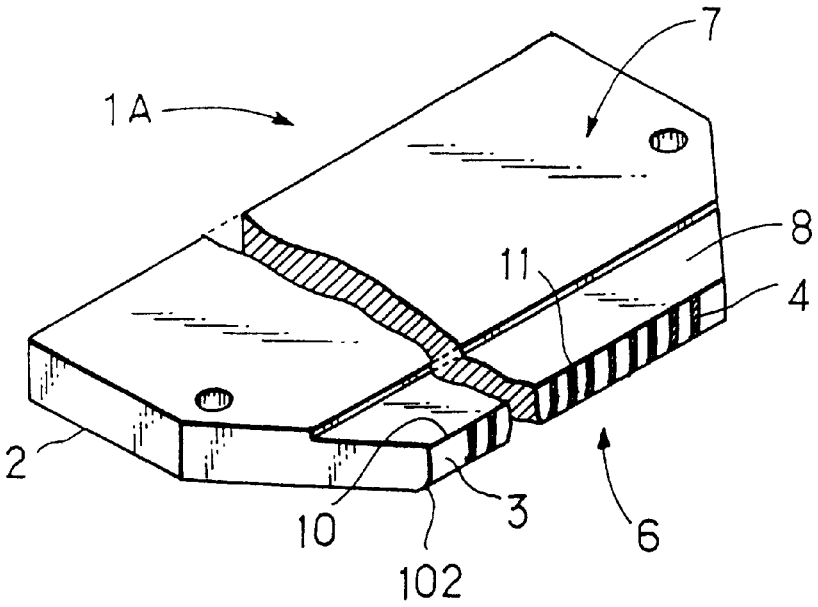
FIG. 1 is a perspective view of a charging plate for liquid jet charging devices in a first embodiment of the present invention, when viewed from above.

In the following, preferred embodiments of the present invention will be described, referring to the accompanying drawings.

A charging plate 1A in a first embodiment of the present invention has such a construction that an unrounded edge 10 at which a work surface 8 on an upper surface 7 intersects with one side surface 3 is formed on a substrate 2 made of non-conductive material, such as ceramics, a plurality of electrodes 4 made of conductive material are disposed at almost equal intervals in the longitudinal direction of the unrounded edge 10, with the distal ends 11 of the electrodes 4 aligned with the unrounded edge 10, and current-carrying parts 5 that extend with a conductive material from the electrodes 4 on the side surface 3 to the lower surface 6 via a rounded edge 102 as shown in the figure.

The angle θ1 (see FIG. 3) which the work surface 8 of the upper surface 7 forming the unrounded edge 10 forms with the side surface 3 is almost a right angle.

The shape of the side surface 3 on which the electrodes 4 are provided need not be a flat surface, but may have an appropriate curvature (not shown) in the thickness direction.

Figure 2:
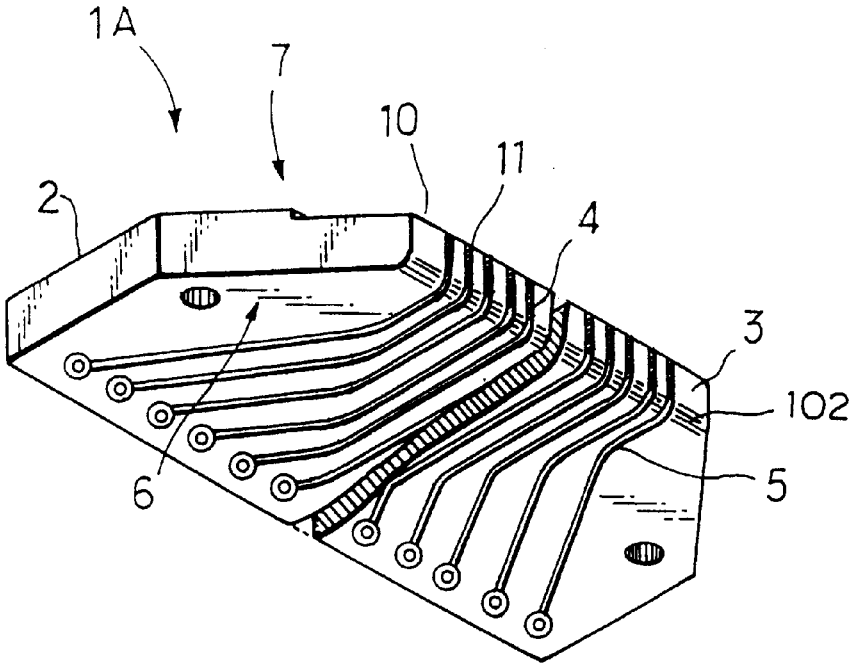
FIG. 2 is a perspective view of the charging plate when viewed from below.
Figure 3:
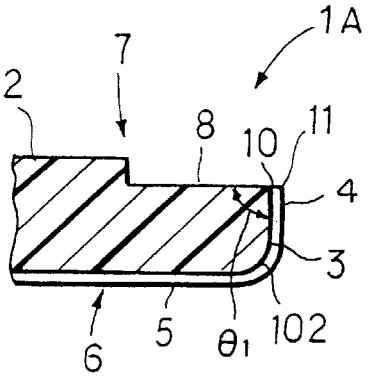
FIG. 3 is a cross-sectional side view of the charging plate.
Figure 4:
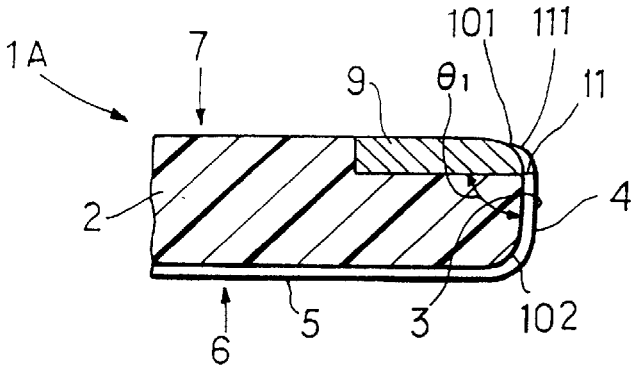
FIG. 4 is a cross-sectional side view of assistance in explaining a method for manufacturing the charging plate.

Next, a method for manufacturing the charging plate 1A in the first embodiment of the present invention as shown in FIGS. 1 through 3 will be described in the following, referring to FIG. 4. The charging plate 1A is manufactured in the first through third steps as shown below.

In the first step, the substrate 2 made of non-conductive material, such as ceramics, is prepared in a thickness slightly larger than at least a desired finished thickness on the side surface 3, say, 1.5 millimeters to 3.0 millimeters, and a film of a conductive and photosensitive material, such as gold paste, is formed by aligning the edge 101 formed by the side surface 3 and the upper surface 7, or an area near the edge 101 with the distal end of the film. The conductive material is formed as a film and cured in a uniform and appropriate thickness over a predetermined range from the side surface 3 to the lower surface 6 via an appropriately rounded edge 102 by aligning the rounded edge 101 or an area near the edge 101 with the distal end of the film.

By appropriately rounding the edge 102 formed by the side surface 3 and the lower surface 6 in advance, the thickness of the conductive film on the outer periphery of the edge 102 can be made equal to the thickness of the conductive film on the side surface and the lower surface 6.

With this, the cross-sectional shape of the conductive material formed on the outer periphery of the edge 102 can be formed uniformly, without causing it to get thinner, as in the case of the cross-sectional shape of the conductive materials on the side surface 3 and the lower surface 6.

In the second step, the portions of the electrodes 4 and the current-carrying parts 5 as extensions from the electrodes 4 on the cured film from the side surface 3 to the lower surface 6 are exposed to light. When the unexposed portions are removed after exposure, the exposed conductive material is left on the substrate 2.

As a result, a plurality of electrodes 4 are formed on the side surface 3, and a plurality of current-carrying parts 5 as extensions from the lower ends of the electrodes 4 are formed on the lower surface 6.

Instead of forming a conductive film on the substrate 2 in the above description, electrodes 4 and current-carrying parts may be formed by depositing a conductive metallic foil that can be etched on a non-conductive material, forming a corrosion-preventive film consisting of electrodes 4 and current-carrying parts 5 on the surface of the conductive metallic foil by photolithography or offset printing process, and removing the unnecessary portions of the conductive metallic foil by etching, in much the same manner as in the manufacture of printed circuit boards.

The distal end 111 of the electrode 4 as formed in the preceding processes tends to be irregular in shape. In the third step, therefore, a portion to be removed 9 from the upper surface 7 is removed, together with the distal ends 111 of the electrodes 4, by grinding or cutting so that the side surface 3 of the charging plate 1A can be made to a desired thickness.

As shown in FIGS. 1 through 4, the unrounded edge 10 constituting the work surface 8 and the side surface 3 formed by the removal step is aligned precisely with the distal ends of the electrodes 4 while maintaining a uniform cross-sectional shape.

It needs no explanation that the range of the work surface 8 to be formed by removing the portion to be removed 9 so that the side surface 3 can be made to a desired thickness may be the entire upper surface 7 of the substrate 2 in this removal step, that is, the third step.

Figure 5:
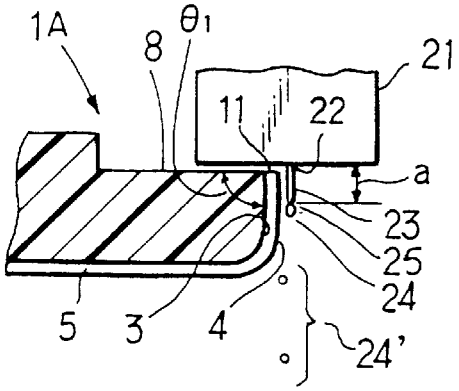
FIG. 5 is a cross-sectional side view of assistance in explaining the state where the charging plate is installed in a liquid jet charging device.

The charging plate 1A formed in the aforementioned manner in the first embodiment of the present invention makes it possible to bring the distal ends of the electrodes 4 formed on the side surface 3 of the charging plate 1A close to the orifice member 21 fitted to the liquid jet charging device, as shown in FIG. 5, and at the same time to bring the electrodes 4 very close to a droplet forming point 25 of the liquid filament 23 injectors through the orifice 22 of the orifice member 21. Thus, the liquid filament 23 can be charged immediately and in a stable state as the need arises.

Consequently, the droplets 24 and 24' falling down from the liquid filament 23 injected through the orifice 22 can be trickled in an invariably charged state as the need arises.

In the charging plate 1A in the first embodiment of the present invention shown in FIGS. 1 through 5, the angle θ1 which the work surface 8 on the upper surface 7 on which an unrounded edge 10 is formed forms with the side surface 3 is an almost right angle, but the present invention need not be limited to it. The angle θ1 may be an almost right angle, or an angle slightly smaller that right angles.

Figure 6:
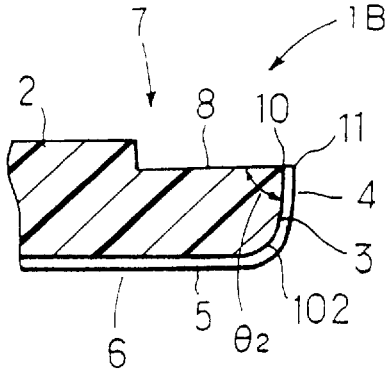
FIG. 6 is a cross-sectional side view of a charging plate for liquid jet charging devices in a second embodiment of the present invention.

FIG. 6 shows a charging plate 1B in a second embodiment of the present invention in which the angle θ2 which the work surface 8 on the upper surface 7 having thereon the unrounded edge 10 forms with the side surface 3 is an angle smaller than right angles (approx. 75").

Figure 7:
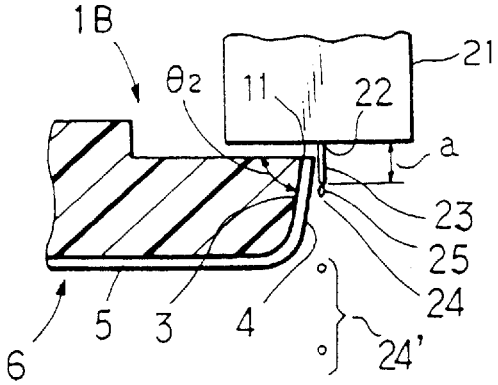
FIG. 7 is a cross-sectional side view of assistance in explaining the state where the charging plate is installed in a liquid jet charging device.
Figure 8:
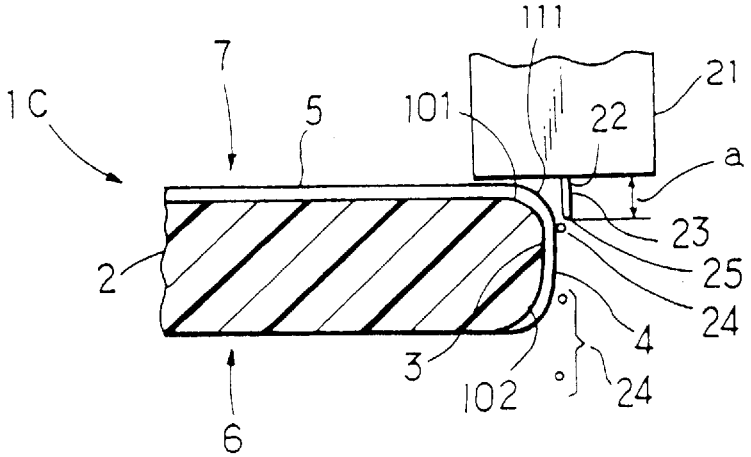
FIG. 8 (PRIOR ART)
FIG. 8 is a cross-sectional side view of assistance in explaining the conviction of a liquid jet charging device.

The charging, plate 1B in the second embodiment of the present invention shown in FIG. 6 makes it possible to bring the distal ends of the electrodes 4 formed on the side surface 3 of the charging plate 1A close to the orifice member 21 fitted to the liquid jet charging device, as shown in FIG. 7, and at the same time, to bring the electrodes 4 very close to a droplet forming point 25 of the liquid filament 23 injected through the orifice 22 of the orifice member 21. Thus, the liquid filament 23 can be charged immediately and in a stable state as the need arises.

Consequently, the droplets 24 and 24' falling down from the liquid filament 23 injected through the orifice 22 can be trickled in a reliably charged state as the need arises.

As is evident from the foregoing description, the charging plate for liquid jet charging devices according to the present invention makes it possible to bring the distal ends of the electrodes close to the orifice, and bring the electrodes very effectively close to the liquid filament and the droplet forming point by forming on a substrate made of non-conductive material an unrounded edge on which a work surface on the upper surface of the substrate intersects with one side surface of the substrate, providing a plurality of electrodes made of conductive material on the side surface at almost equal intervals in the longitudinal direction of the edge, with the distal ends of the electrodes aligned with the unrounded edge, and forming on the lower surface of the substrate current-carrying parts that are individually extended from the electrodes with conductive material, with the angle which the work surface forms with the side surface being set to a right angle or an angle slightly smaller than right angles.

Furthermore, the charging plate makes it possible to improve the quality of printed images because the liquid filament injected through the orifice can be charged immediately and in a stable state as the need arises and the droplets can be trickled from the liquid filament in a reliably charged state as the need arises, so that the charged droplets can be selectively deflected by electrical action.

A method for manufacturing a charging plate according to the present invention, moreover, makes it possible to eliminate faulty electrical continuity caused by poor joint between the electrodes and the current-carrying parts because the electrodes and the current-carrying parts leading to the electrodes are formed simultaneously. In addition, the method for manufacturing a charging plate according the present invention can reduce manufacturing cost because the manufacturing process is so simple and easy that manufacturing man-hours can be substantially reduced, compared with the conventional manufacturing methods.

Machining for forming an edge having the distal ends of electrodes aligned therewith can be accomplished easily with a normal grinding or cutting operation in the final step of the manufacture of charging plates. Thus, high-quality charging plates can be manufactured at low cost.

What is claimed is:

1. A charging plate arrangement for liquid jet charging devices in which liquid filaments injected through orifices provided on an orifice member are charged, so that charged droplets are produced by subdividing the liquid filaments, formed by the process comprising the steps of:

forming, by removing material from a first surface, an unrounded edge at which a work surface on said first surface intersects with a side surface on a substrate made of non-conductive material;

forming a plurality of electrodes with continuous current-carrying extensions, each of a respective said electrode, made of conductive material on said side surface of the substrate with a distal end thereof aligned with the unrounded edge, at intervals in a longitudinal direction of the edge, with said current-carrying extensions extending away from said electrodes along said second surface, said side surface transitioning into said second surface through a rounded transition, said electrodes transitioning into said current-carrying extensions and following said rounded transition from said side surface to said second surface, wherein the work surface on the first surface and the side surface of the substrate, both constituting the edge, form an almost right angle or a slightly smaller angle than a right angle, said work surface being spaced from a remainder of said first surface; and positioning an orifice member with an orifice against said work surface.

2. A charging plate arrangement in accordance with claim 1:

wherein said electrodes and said current carrying extensions of said electrodes are of a uniform thickness as they follow said rounded transition.

3. A charging plate arrangement comprising:

a substrate having first and second surfaces on diametrically opposite first and second sides of said substrate, said substrate having a side surface forming a first edge with said first surface and forming a second edge with said second surface, said first surface and said side surface intersecting at an angle to form an unrounded edge, said side surface transitioning into said second surface through a rounded transition, said first surface also including a raised surface, said raised surface being spaced further from said second side than said first surface;

an electrode on said substrate, said electrode extending over said side surface from said first edge, around said rounded transition and along said second surface;

an orifice member arranged adjacent said first surface of said substrate, said orifice member ejecting liquid in a direction substantially parallel to said side surface.

4. An arrangement in accordance with claim 3, wherein:

said orifice member is spaced from said first surface, said orifice member being closer to said first surface than to said second surface, said orifice member ejects liquid initially in a filament which then divides into droplets;

said electrode is arranged where the filament divides into the droplets.

5. An arrangement in accordance with claim 3, wherein:

said electrode has a substantially constant shape and size from a middle of said side surface to said first edge.

6. An arrangement in accordance with claim 3, wherein:

a plurality of said electrodes are arranged on said substrate, said plurality of electrodes are arranged in a longitudinal direction of said first edge on said side surface.

7. An arrangement in accordance with claim 3, wherein:

said angle of intersection of said first and side surfaces is substantially equal to 75 degrees.

8. An arrangement in accordance with claim 3, wherein:

said angle of intersection of said first and side surfaces is less than or substantially equal to 90 degrees.

9. a charging plate arrangement in accordance with claim 3:

wherein said electrodes are of a uniform thickness as they followed said rounded transition.

10. An arrangement in accordance with claim 3, wherein:

said first edge has a radius of less than 0.5 mm.

11. An arrangement in accordance with claim 10, wherein:

said orifice member is spaced from said first surface, said orifice member being closer to said first surface than to said second surface;

said electrode has a substantially constant shape and size from a middle of said side surface to said first edge;

a plurality of said electrodes are arranged on said substrate, said plurality of electrodes are arranged in a longitudinal direction of said first edge on said side surface;

said angle of intersection of said first and side surfaces is less than, or substantially equal to, 90 degrees.

12. A charging plate arrangement formed by the process comprising the steps of:

providing a substrate having first and second surfaces on diametrically opposite sides of said substrate, said substrate having a side surface forming a first edge with said first surface, and said side surface transitioning into said second surface through a rounded transition;

applying an electrode on said substrate, said electrode extending over said side surface from an electrode distal end at said first edge, around said rounded transition and along said second surface;

removing a portion of said first surface, said side surface and said electrode distal end to form a work surface intersecting said side surface at an angle, said removing also terminating said electrode distal end at said work surface with a shape and size substantially constant with a shape and size of said electrode at a middle of said side surface, said first surface being spaced further from said second surface than said work surface;

arranging an orifice member at a side of said substrate adjacent said first surface of said substrate, said orifice member ejecting liquid in a direction substantially parallel to said side surface.

13. An arrangement in accordance with claim 12, wherein:

said orifice member is spaced from said first surface, said orifice member being closer to said first surface than to said second surface, said orifice member ejects liquid initially in a filament which then divides into droplets;

said electrode is arranged where the filament divides into the droplets.

14. An arrangement in accordance with claim 12, wherein:

a plurality of said electrodes are arranged on said substrate, said plurality of electrodes are arranged in a longitudinal direction of said first edge on said side surface.

15. An arrangement in accordance with claim 12, wherein:

said angle of intersection of said first and side surfaces is substantially equal to 75 degrees.

16. An arrangement in accordance with claim 12, wherein:

said angle of intersection of said first and side surfaces is less than 90 degrees.

17. An arrangement in accordance with claim 12, wherein:

said first edge is unrounded and has a radius of less than 0.5 mm.

18. An arrangement in accordance with claim 17, wherein:

said orifice member is spaced from said first surface, said orifice member being closer to said first surface than to said second surface;

a plurality of said electrodes are arranged on said substrate, said plurality of electrodes are arranged in a longitudinal direction of said first edge on said side surface;

said angle of intersection of said first and side surfaces is less than, or substantially equal to, 90 degrees.

* * * * *